US007083689B2

(12) United States Patent
Park

(10) Patent No.: US 7,083,689 B2
(45) Date of Patent: Aug. 1, 2006

(54) METHOD FOR FABRICATING MAGNESIUM ALLOY BILLETS FOR A THIXOFORMING PROCESS

(75) Inventor: Soon Chan Park, Gwangmyeong-si (KR)

(73) Assignee: Hyundai Motor Company, Seoul (KR)

( * ) Notice: Subject to any disclaimer, the term of this patent is extended or adjusted under 35 U.S.C. 154(b) by 252 days.

(21) Appl. No.: 10/750,654

(22) Filed: Dec. 31, 2003

(65) Prior Publication Data

US 2004/0206428 A1 Oct. 21, 2004

(30) Foreign Application Priority Data

Apr. 21, 2003 (KR) ..... 10-2003-0025064

(51) Int. Cl.
*C22F 1/06* (2006.01)

(52) U.S. Cl. ..... 148/667

(58) Field of Classification Search ..... 148/667
See application file for complete search history.

(56) References Cited

U.S. PATENT DOCUMENTS 2,294,648 A * 9/1942 Gerhard et al. ..... 148/667
6,120,625 A * 9/2000 Zhou et al. ..... 148/690

FOREIGN PATENT DOCUMENTS

JP 08-074015 3/1996
JP 2000-186616 7/2000
JP 2001-316753 11/2001
JP 2003-183794 7/2003
TW 536558 A * 6/2003

OTHER PUBLICATIONS

Hseu et al., Grain Refinement of Magnesium Alloy Billets for Thixoforming, Jul. 12, 1996, Materials Research 96—The Institute of Metals and Materials Australasia Ltd—Conference Proceedings vol. lll—Brisbane, Australia, 136-139.*

* cited by examiner

*Primary Examiner*—Roy King
*Assistant Examiner*—Michael P. Alexander
(74) *Attorney, Agent, or Firm*—Morgan Lewis & Bockius LLP

(57) ABSTRACT

A method for fabricating a magnesium alloy billet for a thixoforming process capable of enhancing the mechanical properties of a forming product by inducing plastic deformation of an AZ91D magnesium alloy included extrusion and compression and forming a fine recrystallized microstructure from a primary solid phase through an isothermal holding process by a 'strain induced melt activated process.' In the case in which the magnesium alloy fabricated according to the present invention is adapted to a material used for a power train part, a chassis part or an interior part of a vehicle, it is possible to fabricate a part having a thick region and a region with a complicated shape. Such a fabrication is impossible in the conventional die casting process.

3 Claims, 3 Drawing Sheets

METHOD FOR FABRICATING MAGNESIUM ALLOY BILLETS FOR A THIXOFORMING PROCESS

CROSS-REFERENCE TO RELATED APPLICATIONS

This application claims priority of Korean Application No. 10-2003-25064, filed Apr. 21, 2003, the disclosure of which is incorporated fully herein by reference.

FIELD OF THE INVENTION

The present invention relates to a method of fabricating a magnesium alloy billet for a thixoforming process and, more particularly to such a method that enhances the mechanical properties of the forming product by inducing plastic deformation in an AZ91D magnesium alloy.

BACKGROUND OF THE INVENTION

Generally, a magnesium alloy has been widely used as a material capable of making parts of a vehicle light, so that the fuel consumption rate is enhanced. The magnesium alloy part adapted to a vehicle is generally fabricated in a die casting process. The die casting process method is directed to fabricating a casting that is the same as the mold by injecting a melted metal into a steel mold that has been precisely fabricated to a casting shape. When fabricating a magnesium part, however, it is impossible to control a casting defect such as a pore, etc. due to a characteristic of a die casting process. Therefore, strength enhancement via heat treatment of castings after die casting is impossible. In addition, an actual shape molding is not performed in the conventional process, so that an expensive machining process is also performed.

As a new forming technique, a thixoforming process has been widely used wherein it is combined with a hot working process including a casting process, an extrusion process and a compression process. The alloys are heated to a solid/liquid coexistence region and are processed by an isothermal holding process during a certain time period. Therefore, the primary solid phases, each having a spherical shape, are uniformly provided in a liquid phase thereby fabricating a slurry. Thereafter, a forming process is performed for fabricating a product.

As a method for fabricating a magnesium alloy using a thixoforming process, according to the Japanese patent No. Hei 8-74015, a billet is fabricated in such a manner that a melt is cooled and hardened at a cooling speed of 1° C./second in a temperature region in which a heating temperature does not exceed 30° C. in a liquidus line in connection with a mold co-heating temperature. The alloy is maintained for 60 minutes at a temperature 0.5° C. higher than a temperature of a solidus line. According to the Japanese patent No. 2001-316753, in order to enhance strength, a magnesium alloy fabrication method is provided based on a thixoforming process in a state that a solid phase is less than 50%. In addition, according to the Japanese patent No. 2003-183794, a magnesium billet is heated in a temperature ranging from 400° C. to 500° C. and is extruded at a container temperature from 380° C. to 440° C., and at an outlet temperature of an extrusions from 400° C. to 480° C. A thin and wider plate material is fabricated with an extrusion ratio from 130 to 670.

In an example of a part for a vehicle using a magnesium thixoforming process, there is a piston for an internal combustion engine disclosed in the Japanese patent laid-open No. 2000-186616. However, the casting material billet used in the thixoforming process requires expensive equipment for agitating the melted mixture during a process in which the billet is fabricated through a cooling process after the casting process is performed. Therefore, the materials for thixoforming process are expensive as compared to the materials for common casting process.

In the product fabricated through the thixoforming process, the size of the primary solid phase largely affects the characteristics of the product. Namely, the agglomeration and coarsening of the primary solid phase disadvantageously affect the mechanical properties of the products during an isothermal holding process in a solid liquid coexistence region after the alloy casting material billet is heated in the thixoforming process. However, when a magnesium alloy is adapted to the thixoforming process, there are not any methods for directly using the common casting material as a billet and for preventing a coursing phenomenon of the primary solid phase.

SUMMARY OF THE INVENTION

Embodiments of the present invention provide a method for fabricating a magnesium alloy billet for a thixoforming process. In order to fabricate a billet having a size of a micro primary solid phase during a thixoforming process with respect to a common casting material, extrusion and compression processes are performed with respect to an AZ91D magnesium alloy that has been widely used as a die casting alloy for thereby achieving a certain deformation by a plastic process. A primary solid phase is made to have a micro-recrystallized structure through an isothermal holding process based on a principle of 'Strain Induced Melt Activated Process' for thereby enhancing a mechanical properties of products.

In an embodiment of the present invention, a method for fabricating a magnesium alloy billet for a thixoforming process includes a step in which an AZ91D magnesium alloy casting material processed through a casting material fabrication process is processed by extrusion and compression processes and an isothermal holding process, respectively, wherein the method for fabricating a magnesium alloy billet for a thixoforming process comprises a step in which a temperature increasing step is performed in the isothermal holding process for increasing the temperature up to an isothermal holding temperature for thereby obtaining a primary solid phase having a size of about 40–60 μm. The extrusion process is performed at a temperature of about 350–400° C. and a compression ratio of about 30–50:1. The compression process is performed at a temperature of about 200–220° C. and a nominal deformation ratio of about 20–40%. The isothermal holding process is performed at an isothermal holding temperature of about 570–580° C. for about 30 seconds through about 180 seconds. The heating rate up to the isothermal holding temperature is from about 1.0–5.0° C./sec.

BRIEF DESCRIPTION OF THE DRAWINGS

The aforementioned aspects and other features of the present invention will be explained in the following description, taken in conjunction with the accompanying drawings, wherein.

DETAILED DESCRIPTION OF PREFERRED EMBODIMENTS

Hereinafter, such embodiments of the present invention are described in detail with reference to the accompanying drawings.

In preferred embodiments of the present invention, an AZ91D magnesium alloy is used as a basic material. The AZ91D may be provided as a cast ingot having a certain diameter and a length.

The AZ91D magnesium is fabricated using Mg as a main material. Al of 8.3–9.7 weight %, Zn of 0.35–1.0 weight %, Mn of 0.15–0.5 weight % and small amount of other impurities are added to the AZ91D magnesium. The AZ91D magnesium alloy is generally used for fabricating a castings of a vehicle part requiring high strength.

In the present invention, in an isothermal holding process needed for a thixoforming process with respect to an AZ91D magnesium alloy, there is provided a process for fabricating a billet for a thixoforming process formed of a micro primary solid phase having a size of about 40–60 μm. The above process will be described with reference to FIG. 1.

Figure 1:
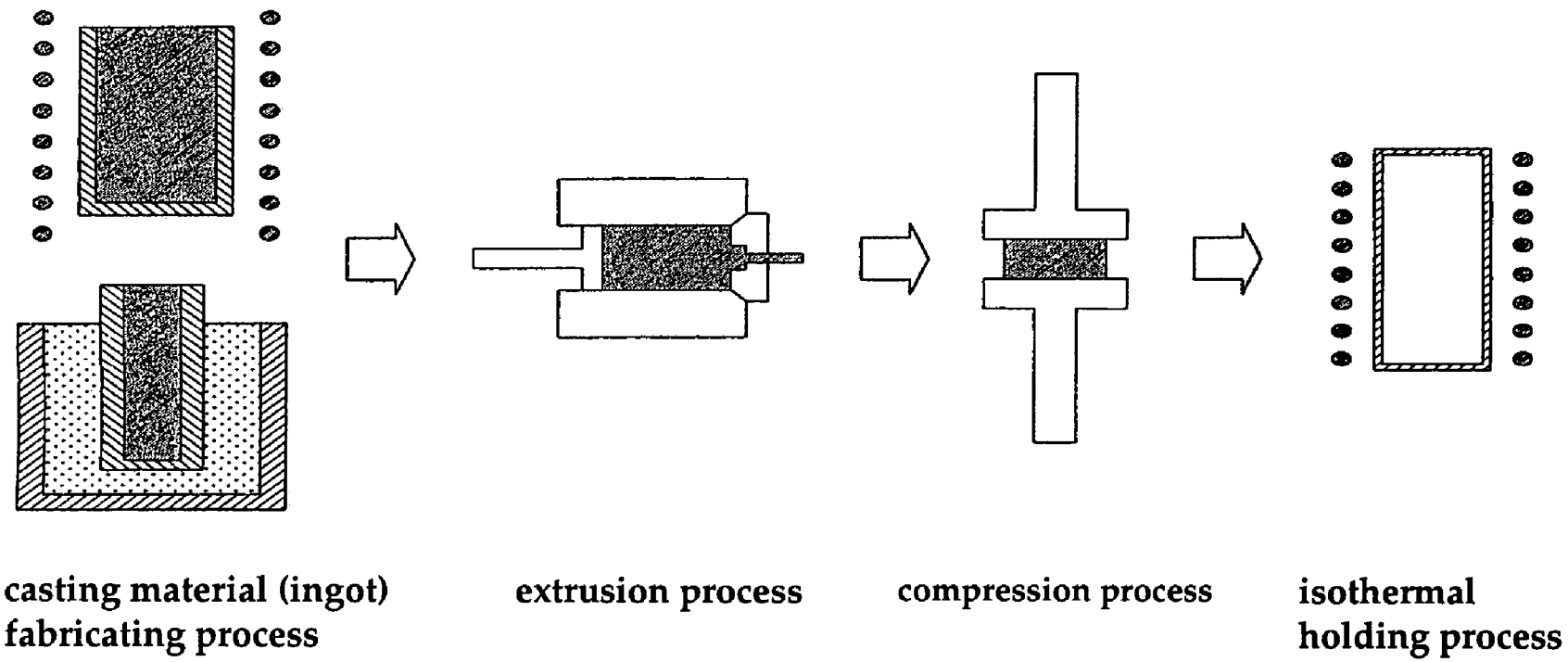
FIG. 1 is a view illustrating a method for fabricating a magnesium alloy billet for a thixoforming process according to the present invention.

FIG. 1 shows a method for fabricating a magnesium alloy billet for a thixoforming process according to the present invention. First, an extrusions is fabricated at a temperature of about 350–400° C. with respect to an AZ91D magnesium ingot. Here, the extrusion process will be described first. An extrusion ratio (cross section area of material/cross section area after extrusion) is from about 30–50:1. An extrusion die angle is about 180°, and a ram speed is about 2–3 cm/min. The above extrusion condition is set with reference to a common process condition generally used for an extrusion of the magnesium alloy. In the case in which the extrusion temperature is less than about 350° C., an extrusion is impossible because a sufficient material formability is not obtained. In the case in which the extrusion temperature exceeds about 350° C., a friction heat with an extrusion die makes a local melting and material ignition. Therefore, the above extrusion temperature range is set to exceed about 350° C.

In the case in which the extrusion ratio is less than 30:1, it is impossible to apply a sufficient strain energy, and in the case in which it exceeds 50:1, the extrusion process is impossible because the extrusion pressure is increased.

The extrusion die angle corresponds to the die angle in the extruder actually adapted at a construction place. In the case in which the ram speed is out of a certain set range, a crack may occur on the surface of the extrusion product, so that it is impossible to fabricate a desired good extrusion material.

The material, the extruder container, and the extrusion die are preheated within a range of an extrusion temperature for about 30–60 minutes before the extrusion process is performed. In the present invention, a rod shaped extrusions having a diameter of about 25–50 mm is fabricated. The extrusion condition is experimentally set based on an extrusion condition commonly applied to the magnesium alloy.

The above extrusion process corresponds to a necessary preprocess performed for maximizing the characteristics of the present invention when strain is induced based on the compression process. It is possible to induce a partial strain through a hot working by the extrusion process. As a result, it is possible to provide a material type easily adapted to the compression process.

Next, in the present invention, the compression process is performed as a cold working for providing a sufficient strain to the material. The above compression process is necessary for forming a spherical primary solid phase during the thixoforming process and isothermal holding process using the strain induced melt activation principle.

Here, the strain induced melt activation principle is to obtain a spherical primary solid phase formed of a recrystallized microstructures by heating a solid alloy to a solid liquid coexistence temperature after the alloy is induced to a sufficient strain through the hot or cold working for thereby obtaining a spherical primary solid phase. Namely, when the material is enough deformed and is recrystallized to a structure having a micro grain size, a liquid phase is penetrated into a grain based on a partial melting, so that spherical solid phase is uniformly distributed in the liquid phase. Therefore, it is possible to obtain a recrystallized microstructures needed for the thixoforming process under the above condition. It is thus important to set a compression process condition such as a temperature, deformation ratio, etc. for obtaining a recrystallized micro structures. However, when the material is compressed at a room temperature, it may be destroyed before plastic deformation is applied to the material due to the property of the AZ91D magnesium alloy. Namely, in the case in which the compression temperature is high, a recrystallized microstructure is grown. Therefore, in the present invention, the compression temperature is set to about 200–220° C. based on a result of various experiments in order to obtain a recrystallized microstructures with a grain size of about 40–60 μm. The nominal strain (changed length/minimum length) determined based on the compression is set to about 20–40%.

In preferred embodiment of the present invention, the isothermal holding process is performed with respect to the thusly fabricated magnesium alloy for about 30–180 seconds at a temperature of about 570–580° C., that is, a temperature range of a solid liquid coexistence range. The isothermal holding process is a necessary process performed for providing the material to the forming process after a spherical primary solid phase is obtained in the thixoforming process. At this time, the isothermal holding temperature of about 570–580° C. is set based on the working conditions during the thixoforming process. Generally, it is possible to obtain a spherical primary solid phase based on an isothermal temperature corresponding to the range that the solid phase ratio of the material is in a range of about 50–60% during the thixoforming process. In the case of the AZ91D magnesium alloy according to the present invention, the liquidus temperature corresponds to about 598° C., and the solidus temperature corresponds to about 468° C.

Therefore, the above temperature range corresponds to a solid liquid coexistence region. The isothermal holding temperature is set to about 570–580° C. based on a computation performed in order for the solid phase ratio to have about 50–60% by adapting a lever rule on a Mg—Al binary phase diagram.

Figure 2A:
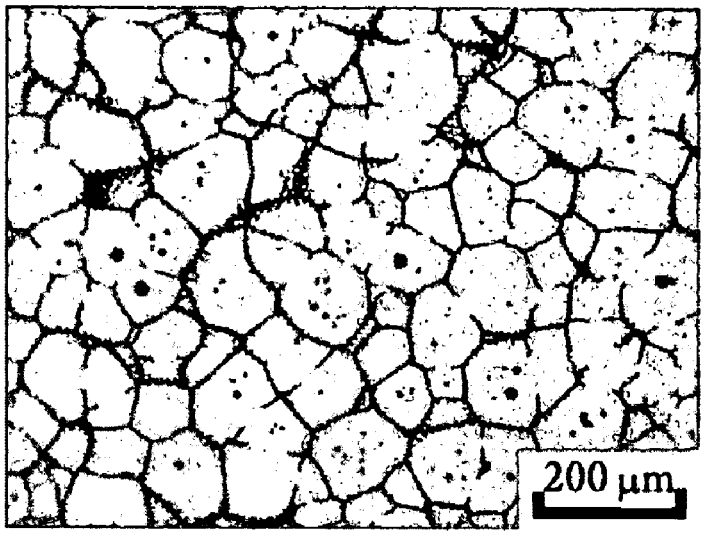
FIGS. 2A and 2B are microscopic pictures of a microstructures according to first and second embodiments of the present invention.
Figure 2B:
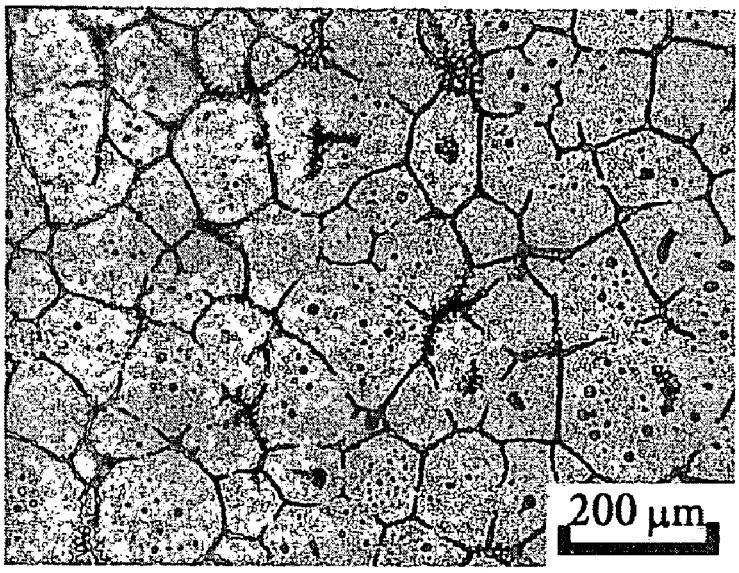

In particular, in a preferred embodiment of the present invention, when the material processed by the compression process is increased to the isothermal holding temperature, the heating rate is set to about 1.0–5.0° C./sec. In the case in which the heating rate is too low, it takes a long time to increase to the isothermal holding temperature. A recrystallized microstructure may be grown in the compression process, so that it is impossible to obtain a fine microstructure. Therefore, in the present invention, the heating rate is set as follows based on the experiments under various conditions. In the first and second embodiments of the present invention, the effect of the heating rate on the size of primary solid phase and the hardness of materials is shown in Table 1. After the isothermal holding process is performed, the magnesium alloy billet for the thixoforming process according to the present invention is processed to fabricate a certain part material through the forming process for thereby being adapted to a vehicle part such as a power train part, such as a Chassis part, an interior part, etc. Therefore, according the fabrication method of the present invention, as shown in FIGS. 2A and 2B, the recrystalled microstructure is obtained with the 40–60 μm size of primary solid, so that it is possible to fabricate a magnesium alloy having an enhanced mechanical properties. In addition, it is possible to fabricate a part having a thick part that is not impossible in the conventional casting and a product with a complicated shape.

Namely, the strain is induced to the conventional AZ91D magnesium alloy casting material based on the plastic process through the extrusion and compression processes. The size of the primary solid phase is significantly decreased. Namely, it is possible to fabricate a new magnesium alloy having an enhanced hardness, an important mechanical property.

The present invention will be described in detail based on the embodiments of the present invention. However, they shall not be construed as limiting the scope of the present invention.

EXAMPLES 1 AND 2

The extrusion process was performed with respect to an AZ91D magnesium alloy ingot under the conditions of a temperature of 350° C. and an extrusion ratio of 35:1. The compression process was performed under the condition of a temperature of 220° C. and a nominal strain of 30%. The heating rate up to the isothermal holding temperature was maintained at 1.0° C./sec and 5.0° C./sec, so that a magnesium alloy billet having a recrystallized microstructure was fabricated.

Comparative Example

The extrusion process was performed with respect to an AZ91D magnesium alloy ingot under the conditions of a temperature of 350° C. and an extrusion ratio of 35:1, and the compression process was performed under the conditions of a temperature of 220° C. and a nominal strain of 30%. The material was held isothermally for one hour at 580° C., i.e., an isothermal holding temperature, so that a magnesium alloy billet was fabricated.

TABLE 1

| Class | Process condition | Size of primary solid phase (μm) | Hardness (Hv) |
|---|---|---|---|
| Embodiment 1 | heating rate 5.0° C./sec | 46 | 88 |
| Embodiment 2 | heating rate 1.0° C./sec | 57 | 84 |
| Embodiment 3 | Isothermal holding for one hour at 580° C. | 220 | 52 |

As shown in Table 1, the sizes of the primary solid phase measured from the microstructures of the first and second embodiments and the comparison example are shown. A result of the hardness measurement performed based on an evaluation of the mechanical property is shown therein also.

Figure 3:
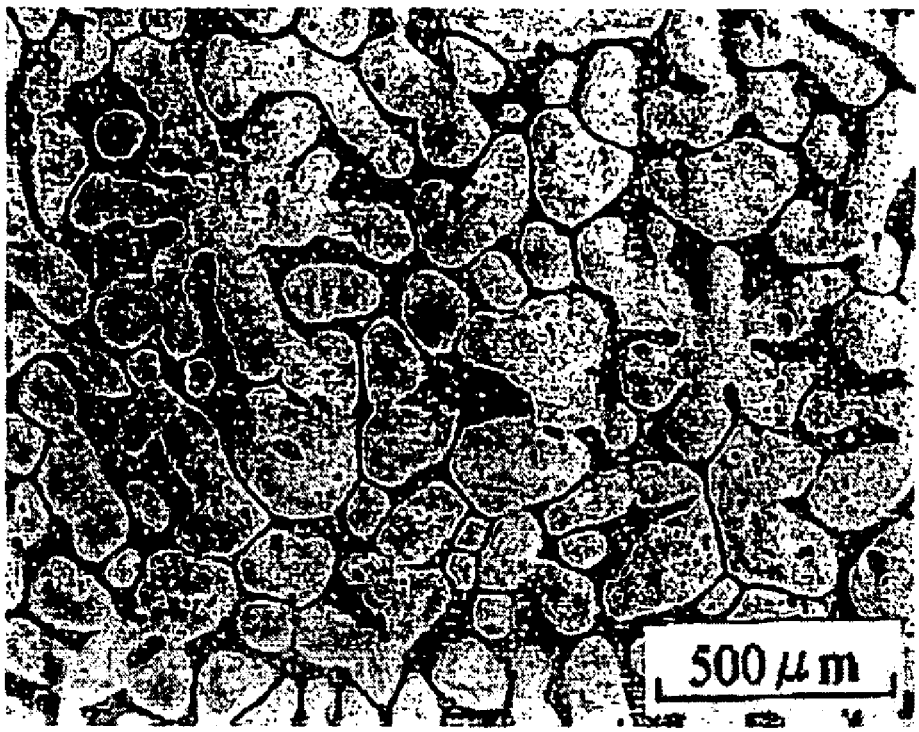
FIG. 3 is a microscope picture of a microstructures of a conventional casting material of a magnesium alloy.

Here, as shown in FIGS. 2A through 3, the sizes of the primary solid phase measured from the microstructure of the first and second embodiment and the comparison example are 36 μm in the first embodiment, 57 μm in the second embodiment, and 220 μm in the comparison example. The size of the primary solid phase decreased with increasing the heating rate. The hardness (Hv), a mechanical property, is 88 Hv in the first embodiment, 84 Hv in the second embodiment, and 52 Hv in the comparison example. As the heating rate is increased, it is known that the hardness is also increased.

As described above, in the method for fabricating a magnesium alloy billet for a thixoforming process according to the present invention, strain is induced to the AZ91D magnesium alloy which has been widely used as a die casting alloy through the extrusion and compression processes. A fine recrystallized microstructure is obtained through the isothermal holding process based on the deformation induction liquefying activation principle. Therefore, the present invention has the following advantages:

1) The size of the spherical primary solid phase is significantly decreased, and the mechanical property is enhanced after the isothermal holding process. The isothermal holding process is necessarily performed for the thixoforming process;

2) In the case that the magnesium alloy fabricated according to the present invention is adapted to a material used for a power train part, such as a Chassis part or an interior part of a vehicle, it is possible to fabricate a part having a thick part and a part having a complicated shape, which are impossible in the conventional die casting process.

What is claimed is:

1. A method for fabricating a magnesium alloy billet for a thixoforming process, comprising processing an AZ91D magnesium alloy ingot by extrusion, compression and isothermal holding, respectively, wherein temperature in the isothermal holding is increased up to an isothermal holding temperature sufficient to obtain a primary solid phase having a size of about 40–60μm;

wherein said alloy is heated at a heating rate of about 1.0–5.0° C./sec. up to the isothermal holding temperature; and wherein the isothermal holding temperature is in a range of about 570–580° C. and is maintained for about 30 seconds through about 180 seconds.

2. The method for fabricating a magnesium alloy billet for a thixoforming process according to claim 1, wherein said extrusion is performed at a temperature range of about 350–400° C. and a compression ratio of about 30–50:1.

3. The method for fabricating a magnesium alloy billet for a thixoforming process according to claim 1, wherein said compression is performed at a temperature range of about 200–220° C. and a nominal strain of about 20–40%.

* * * * *